US006125585A

United States Patent [19]

Koneval et al.

[11] Patent Number: 6,125,585

[45] Date of Patent: Oct. 3, 2000

[54] SLIDING WINDOW REGULATOR

[75] Inventors: Kevin Koneval, Sterling Heights; Jeffrey W. Kolar, Livonia; Charles Hazel, Wolverine, all of Mich.

[73] Assignee: Hi-Lex Corporation, Battle Creek, Mich.

[21] Appl. No.: 09/374,357

[22] Filed: Aug. 16, 1999

[51] Int. Cl.[7] ..... E05F 15/08

[52] U.S. Cl. ..... 49/349; 49/360; 49/352

[58] Field of Search ..... 49/118, 121, 123, 49/360, 375, 380, 358, 352, 349

[56] References Cited

U.S. PATENT DOCUMENTS

| | | | |
|---|---|---|---|
| 4,890,376 | 1/1990 | Boileau | 49/349 |
| 4,920,698 | 5/1990 | Freise et al. | 49/380 |
| 4,995,195 | 2/1991 | Olberding et al. | 49/380 |
| 5,113,620 | 5/1992 | Guillaume et al. | 49/375 |
| 5,147,712 | 9/1992 | Hlavaty | 49/118 |
| 5,531,046 | 7/1996 | Kollar et al. | 49/360 |
| 5,542,214 | 8/1996 | Buening | 49/380 |
| 5,613,323 | 3/1997 | Buening | 49/360 |
| 5,669,181 | 9/1997 | Kollar et al. | 49/360 |
| 5,724,769 | 3/1998 | Cripe et al. | 49/360 |
| 5,784,833 | 7/1998 | Sponable et al. | 49/360 |
| 5,822,922 | 10/1998 | Grumm et al. | 49/360 |
| 6,018,913 | 2/2000 | Lin | 49/360 |
| 6,021,605 | 2/2000 | Laux et al. | 49/375 |

*Primary Examiner*—Daniel P. Stodola
*Assistant Examiner*—Curtis A. Cohen
*Attorney, Agent, or Firm*—Young & Basile, P.C.

[57] ABSTRACT

A window regulator for use with a horizontally sliding window assembly has a channel-like guide rail, an elongated carrier plate slidingly movable along the guide rail, and a cable drive mechanism for moving the carrier plate along the guide rail. Pane engagement pairs are disposed at opposite ends of the carrier plate, each comprising a male feature and a mating female feature. One of the features of each pair is secured to the carrier plate and the mating feature is secured to the sliding pane adjacent an outboard edge thereof. The male/female engagement between the features allows the sliding pane and the carrier plate to move relative to one another along an axis generally perpendicular to the sliding pane, while the two-point engagement between the pane and the carrier plate serves to stabilize the pane and allow it to slide smoothly even if the guide tracks for the sliding pane and the guide rail are less than perfectly flat and parallel to one another. The carrier plate is a unitary, elongated piece extending between the two widely spaced points of attachment with the sliding pane, so that it is more stable as it slides along the guide rail.

13 Claims, 3 Drawing Sheets

10
12
14
16
18
20
22
24
26
28
30
32
33
40

FIG-3
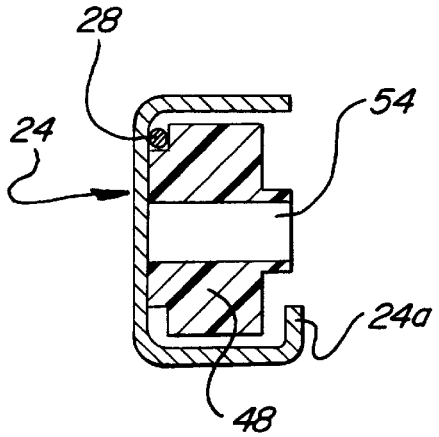
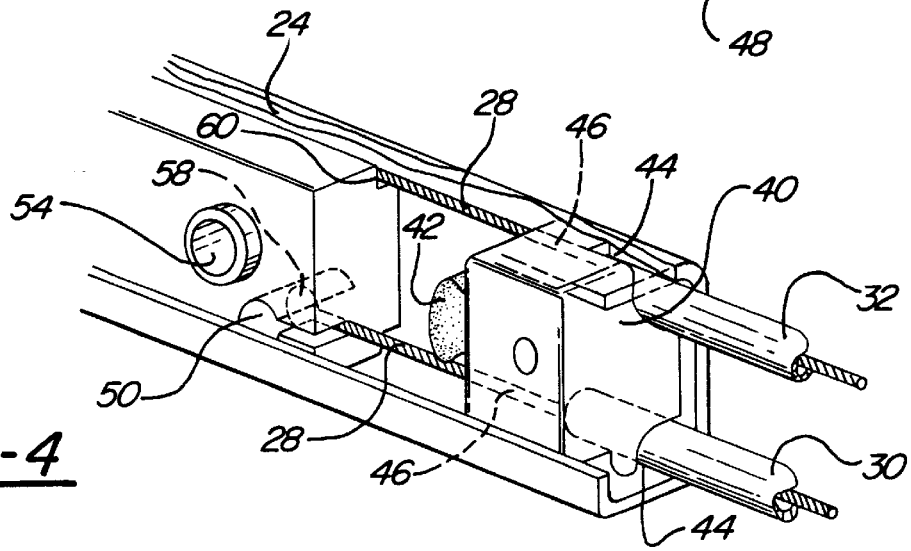
FIG-4
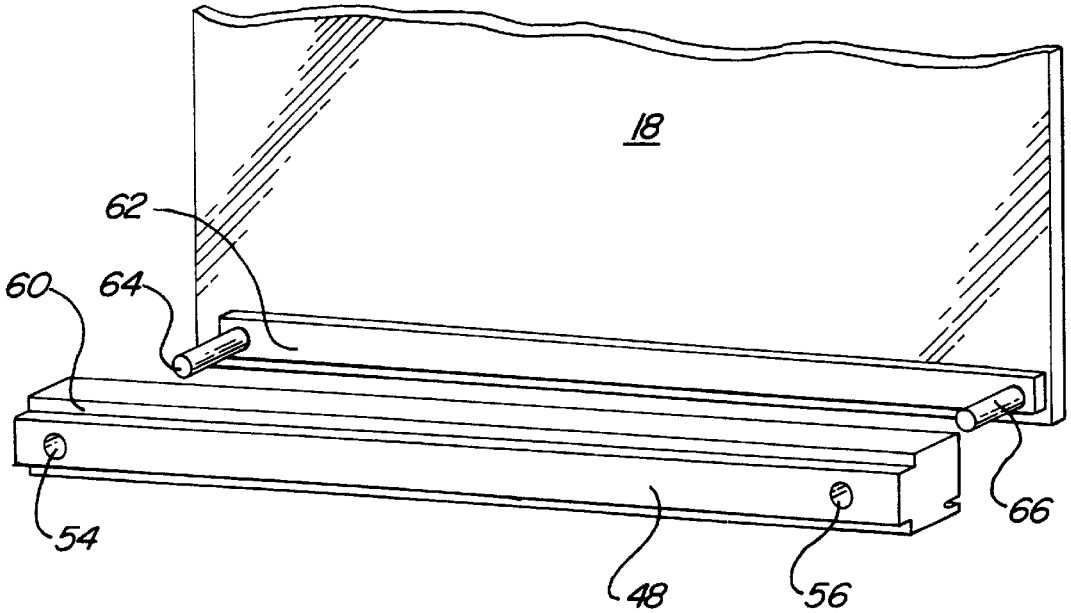
FIG-5

SLIDING WINDOW REGULATOR

FIELD OF THE INVENTION

This invention relates to sliding window assemblies for motor vehicles and more specifically to a powered window regulator for opening and closing sliding window panes.

BACKGROUND OF THE INVENTION

It is known to fit the rear window opening of a truck cab with a sliding window assembly made up of a pair of stationary window panes mounted outboard in a window opening to define an gap therebetween, and one or two window sliding panes retained along their upper and lower edges in guide tracks for horizontal movement between open and closed positions. Many different power window regulator mechanisms have been proposed to allow an occupant of the truck to open and close the sliding window by actuating a switch. These prior art regulator mechanisms generally employ a reversible electric motor to drive a rack-and-pinion mechanism or a flexible, inextensible drive member such as a cable or a slotted tape to move the sliding panes between the open and closed positions.

In many prior art sliding window regulators, a guide track or rail extends parallel to the path of movement of the sliding pane and one or more carrier plates are slidingly engaged with the guide rail and are moved back and forth therealong by one or more flexible drive members. The carrier plates typically make a rigid connection with the sliding pane so that any movement of the pane perpendicular to the direction of sliding movement and any tipping of the pane is transferred directly to the carrier plates, and vice versa. The rigid connection between the carrier plates and the pane may tend to cause binding problems when the track in which the sliding pane travels is not perfectly flat and parallel with the guide track for the carrier plates. U.S. patent application Ser. No. 09/126,649, assigned to the assignee of the present patent application, discloses a window regulator in which a pane carrier engages a sliding pane by means of a sliding male/female connection which restrains the sliding pane against tipping and binding within its guide track yet allows relative movement between the pane carrier and the sliding pane along an axis perpendicular to the pane. This type of connection allows the regulator to operate properly, without binding or jamming, when attached to a window assembly that is not perfectly flat along the direction of sliding movement. It also simplifies the assembly process, since the regulator does not have to be attached to the window assembly with a great deal of precision.

The prior art power sliding window regulators have also generally required a relatively high degree of dimensional accuracy in the window assembly, the regulator, and the interface between these two assemblies. This is a consequence of the drive components of the regulator mechanism being integrated with the window frame and/or guide rails for the sliding panes. In a relatively new type of automotive vehicle window assembly, known as a "frameless" assembly, the fixed window panes are installed directly into the window opening to provide a more simple and clean appearance. Since there is no rigid frame surrounding the window panes, the dimensional accuracy and "flatness" of such an assembly depends upon the construction of the vehicle structure surrounding the window opening. Because of normal manufacturing tolerances, the surrounding structure is likely to be less dimensionally precise than a traditional, separately fabricated window frame.

Several known regulators employ a pull/pull drive system, wherein the drive member is routed so that it is placed in tension and applies a pulling force to the sliding pane to move it in both the opening and closing directions. Such a pull/pull drive configuration allows the cables to be constructed to less exacting dimensional tolerances than would be the case if the cable were placed in compression to push the pane in one of the directions, with a resulting reduction in cost. Pulling the pane also greatly eliminates friction due to binding of the cables and the sliding pane that would be present if a pushing force were applied, thereby allowing the use of a substantially smaller, less powerful and less expensive motor.

One method of achieving a pull/pull drive configuration is taught by U.S. Pat. No. 5,531,046 in which a linear actuator is connected to a sliding pane at two points adjacent the lower, outboard corners of the sliding pane. This allows the single linear actuator to apply the pulling force to the leading lower edge of the pane as it slides in both directions. This design uses two separate carrier plates attached to the sliding pane adjacent opposite lower corners and which slide independently along the guide rail.

U.S. Pat. No. 5,822,922 discloses a regulator which achieves a pull/pull configuration utilizing elongated glass attachments which are secured to the sliding pane along its entire lower edge. While this achieves the desired pull/pull configuration, the glass attachments are rigidly mounted to the sliding pane. The glass attachment also constitutes the guide plate, being engaged with the guide track along its entire length. While this configuration achieves the desired pull/pull configuration, it does not allow any out-of-plane relative movement between the pane and the glass attachment/carrier plate.

SUMMARY OF THE INVENTION

In carrying out this invention in the illustrative embodiment thereof, a window regulator for use with a horizontally sliding window assembly comprises a guide rail extending parallel to the path of travel of a sliding pane, an elongated carrier plate slidingly movable along the guide rail, and a drive mechanism for moving the carrier plate reciprocally along the guide rail. First and second pane engagement pairs are disposed adjacent the opposite ends of the carrier plate, each of which comprises a male feature and a mating female feature. One of the features of each pair is secured to the carrier plate and the other, mating feature is secured to the sliding pane adjacent an outboard edge thereof. The male and female features of each pair engage one another to allow the sliding pane and the carrier plate to move relative to one another along an axis generally perpendicular to the sliding pane, while the two-point engagement between the pane and the carrier plate serves to stabilize the pane and allow it to slide smoothly even if the guide tracks for the sliding pane and the guide rail are less than perfectly flat and parallel to one another.

Because the carrier plate is a unitary, elongated piece extending between the two widely spaced points of attachment with the sliding pane, it is more stable as it slides along the guide rail. The carrier plate also contributes to the stiffness of the guide rail, so that if a person or object inside the vehicle pushes against the guide rail it will not bend and thereby cause binding of the carrier plate within the guide rail.

In the preferred embodiment of the invention, the guide rail comprises a generally C-shaped channel having mounting feet at either end for attaching to the vehicle immediately below the fixed panes or to the fixed panes themselves. The carrier plate travels along the interior of the channel and is actuated by a cable drive system in which the drive unit is located remotely from the guide rail. The drive cable extends from the drive unit to one end of the guide rail, along the inside of the guide rail, and is attached to the carrier plate. This configuration provides a compact, easily manufactured and assembled window regulator which may be installed in a vehicle either as original equipment or after-market equipment with a minimum of impact on the overall design of a vehicle.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein:

FIG. 3 is a cross-sectional view taken along line 3—3 of FIG. 2;

FIG. 4 is a partial perspective view of the interior of the window regulator; and FIG. 5 is an exploded view of the carrier block and glass attachment according to the invention.

DESCRIPTION OF THE PREFERRED EMBODIMENT

Figure 1:
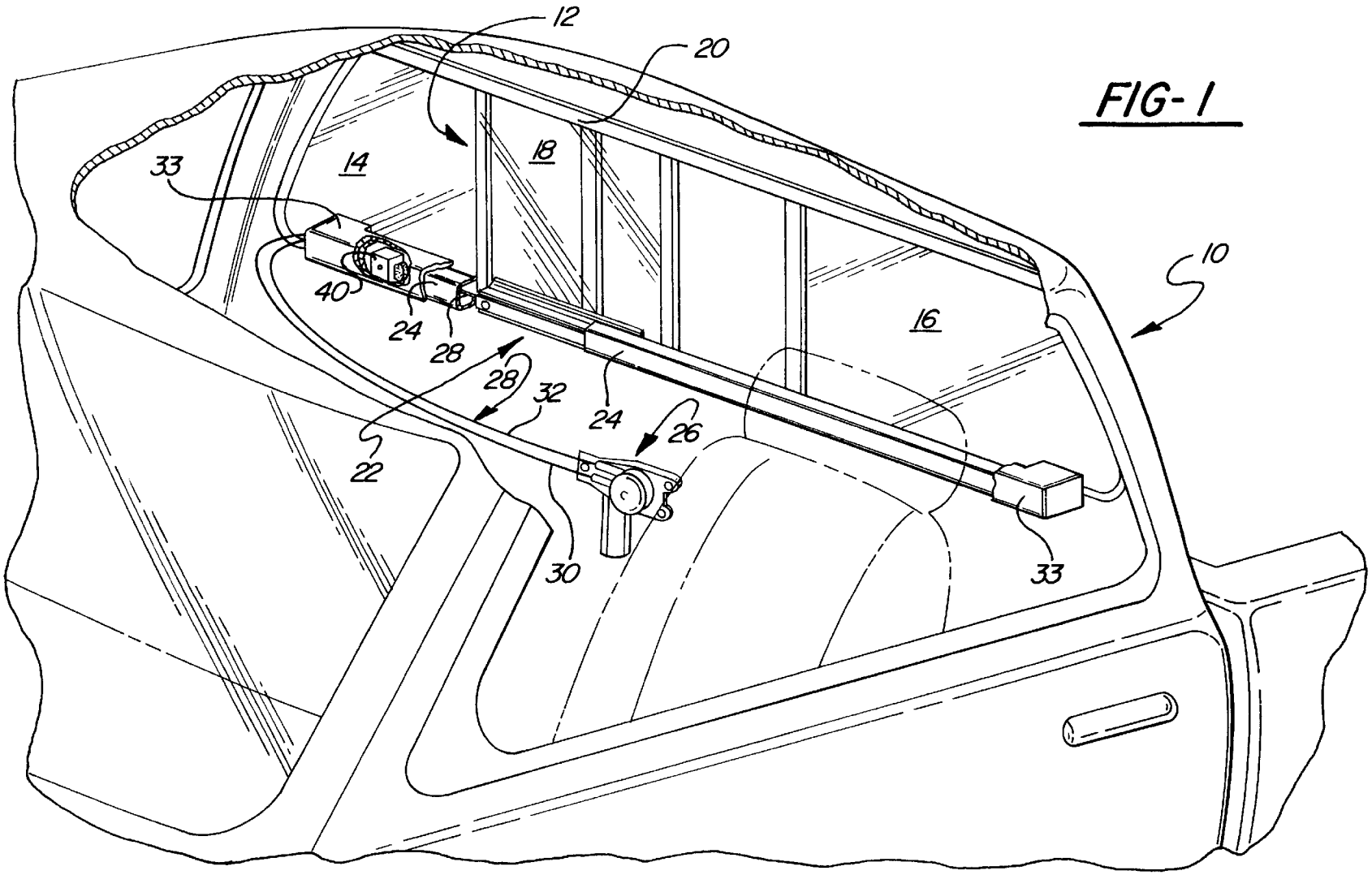
FIG. 1 is a perspective view of a truck cab having a sliding window assembly operated by a regulator according to the present invention.

Referring to FIG. 1, a truck cab 10 includes a window assembly 12 having first and second fixed panes 14,16 located at opposite ends of a rear window opening, and a sliding pane 18 mounted in guide tracks 20 extending across the top and bottom of the window opening. A window regulator 22 according to the present invention comprises an elongated guide rail 24 attached to the window assembly 12 adjacent the lower portion thereof on the interior of the truck cab 10, and a drive unit 26 mounted within the cab at a location remote from the window assembly. A drive cable 28 extends between the drive unit 26 and one end of the guide rail 24 and is enclosed by flexible conduits 30,32. A housing 33 encloses the guide rail 24 to improve the aesthetic appearance of the assembly.

The guide rail 24 is preferably secured at its outboard ends directly to the inner surface of the fixed panes 14,16 by, for example, an adhesive. Alternatively, the guide rail 24 may be attached to the cab structure surrounding the window opening below and/or outboard of the fixed panes 14,16.

As best seen in FIG. 3, the guide rail 24 is generally C-shaped in cross section with an upwardly projecting lip 24*a* extending along the lower flange of the rail. The guide rail 24 is attached to the truck cab 10 so that its open side is oriented toward the window assembly 12. The guide rail 24 is preferably formed of aluminum or a high strength plastic.

Figure 2:
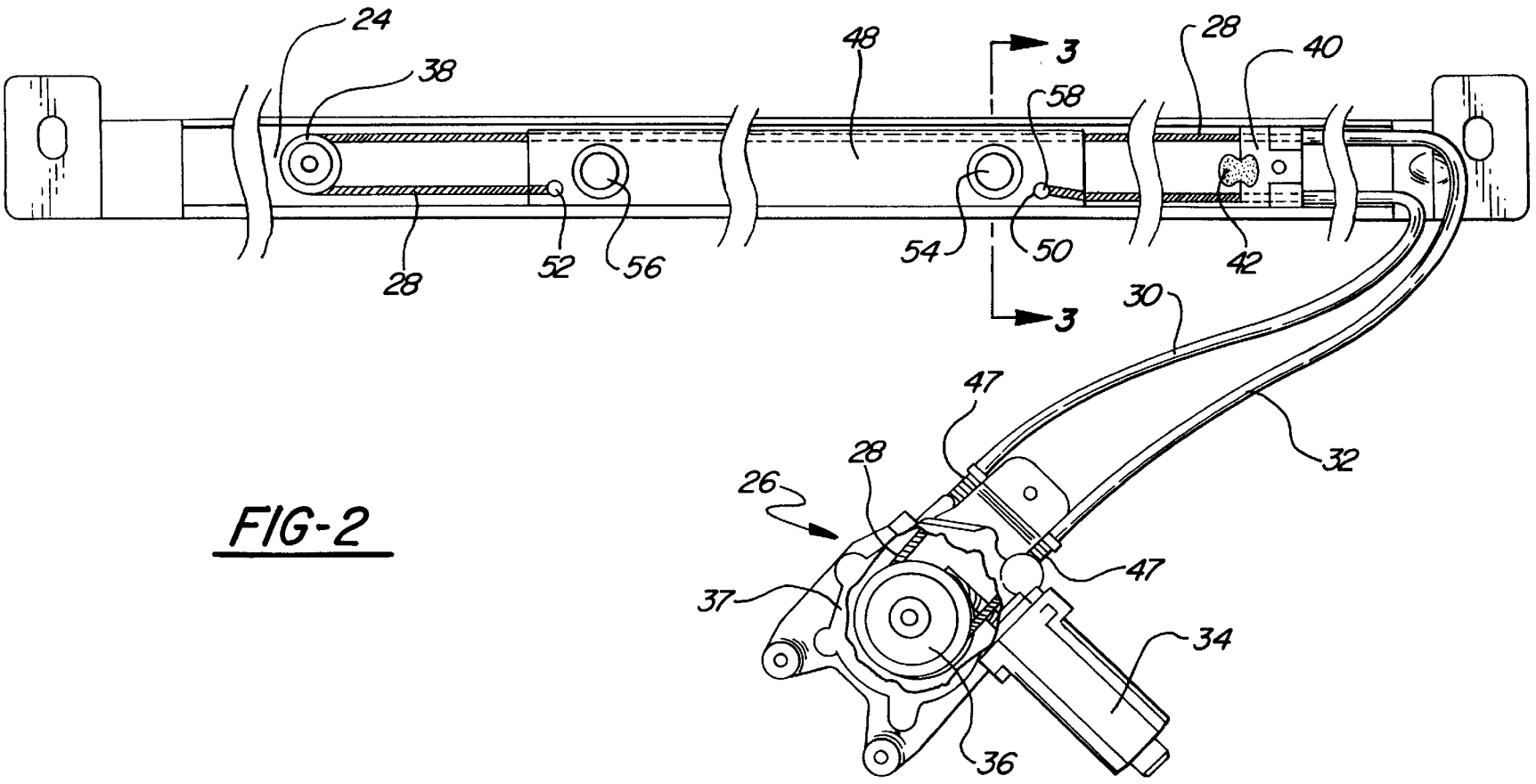
FIG. 2 is a front view of a window regulator according to the present invention.

For convenience of description, the regulator 22 will be referred to herein as having left and right ends as viewed in FIG. 2. Assuming that the regulator 22 is mounted to the window assembly 12 on the inside of the truck cab 10, these terms will correspond to the left and right sides of the vehicle overall.

The drive unit 26 comprises a reversible electric motor 34 which rotates a drive drum 36 enclosed within a casing 37. As is well known in the window regulator art, the drive drum 36 has a spiral cable groove (not shown) formed around the circumference thereof. The motor 34 is supplied with 12-volt DC electrical power from the vehicle electrical system and is controlled by a 3-positioned switch (not shown) located within the truck cab 10 in a position where it may be easily reached by occupants of the cab.

Referring to FIG. 2, a pulley 38 is rotatably mounted to the interior of the guide rail 24 adjacent the left end thereof and an open stop 40 is fixed to the interior of the guide rail 24 adjacent the right end thereof. A bumper 42 formed from rubber or a similar resilient material projects from the open stop 40 toward the center of the guide rail 24. As best seen in FIG. 4, the open stop 40 has recesses 44 extending inwardly from its outboard surface along the corners which contact the guide rail 24, and cable passages 46 extend from the ends of the recesses through to the inboard surface. The ends of the conduits 30,32 are inserted into the recesses 44 with the ends of the drive cable 28 extending through the cable passages 46 and the open stop 40 is secured within the guide rail 24 so that the conduits are trapped between the open stop and the inner surface of the guide rail 24, thereby securely retaining the ends of the conduits in connection with the open stop. The conduits 30,32 and the drive cable 28 extend out the end of the guide rail 24 and to the drive unit 26 where the conduits are attached to the drive unit casing 37, preferably by spring fittings 47 to absorb shock caused by starting and stopping of the motor 34.

A carrier plate 48 is sized to fit into the interior of the guide rail 24 and is approximately equal in length to the sliding pane 18 to which it is to be attached. First and second cable attachment receptacles 50,52 are formed at either end of the carrier plate 48, and first and second holes 54,56 are formed through the carrier plate slightly inboard from the cable receptacles. The carrier plate 48 is preferably injection molded from a plastic material.

A first end of the drive cable 28 extends through the conduit 30 attached to the lower corner of the open stop 40 and is secured to the right end of the carrier plate 48. This may be achieved, for example, by inserting a bead 58 secured to the end of the cable 28 into the receptacle 50 in the carrier plate 48. The other end of the cable 28 extends through the conduit 32 attached to the upper corner of the open stop 40, passes through a notch 60 formed along the upper edge of the carrier plate 48, wraps around the pulley 38 at the left end of the guide rail 24, and is secured to the left end of the carrier plate 48. The middle portion of the cable 28 is wrapped around the drive drum 36, engaging the spiral groove formed therein in the manner well known in the window regulator art.

As an alternative to a single, continuous drive cable 28 that is secured to the carrier plate 48 at either end and wraps around the drive drum 36, it is also within the scope of the present invention to utilize two separate cables extending from opposite ends of the carrier plate 48 and attached to the drive drum 36. Also, the cable or cables can be secured to the carrier plate 48 at any point or points thereon.

As is apparent from FIG. 2, rotation of the drive drum 36 in the counter-clockwise direction pulls on the end of the drive cable 28 attached to the right end of the carrier plate 48, thus sliding the carrier plate 48 toward the open stop 40. Rotation of the drive drum 36 in the clockwise direction pulls on the end of the cable attached to the left end of the carrier plate 48, sliding it toward the pulley 38.

Referring now to FIG. 5, a pane attachment 62 is secured to the surface of the sliding pane 18 adjacent its lower edge, preferably by a suitable adhesive. The pane attachment 62 extends along substantially the full length of the lower edge of the slicing pane 18 and has first and second pegs 64,66 projecting generally perpendicular to the pane at opposite outboard edges thereof. The regulator 22 is installed in the truck cab 10 such that the glass attachment pegs 64,66 are received by the respective holes 54,56 in the carrier plate 48 so that movement of the carrier plate 48 along the guide rail 24 is transferred to the sliding pane 18, moving it between its open and closed positions. The open stop 40 is positioned on the guide rail 24 so as to prevent the sliding pane 18 from moving past its fully open position. Travel of the sliding pane 18 toward the closed position is stopped by engaging a weatherproof seal of the type known in the automotive window art which extends along the vertical inboard edge of the fixed pane.

Together, each carrier plate hole 54,56 and its mating glass attachment peg 64,66 make up a pane engagement pair. The engagement between male feature and the female feature of each pair allows relative movement between the carrier plate 48 and the sliding pane 18 in the direction generally perpendicular to the plane of the sliding pane 18, thus permitting the regulator 22 to operate smoothly and without binding in spite of unevenness along the lower edge of the window assembly 12 or other dimensional imprecision present in the window and regulator 22 assemblies.

The connection between the carrier plate 48 and the sliding pane 18 at two widely spaced points adjacent the outboard edges of the pane prevents relative rotation between the pane and the carrier plate 48. This restrains the sliding pane 18 against any tendency to tip within its guide tracks 20 as it slides therealong, and so reduces the amount of friction drag between the edge of the pane and the guide track. Accordingly, a smaller, less powerful and less expensive motor 34 may be used to drive the regulator 22.

It should be noted that the same advantageous engagement between the pane carrier and sliding pane 18 can be achieved by forming the female feature on the pane attachment 62 and the male feature on the pane carrier. Such a reversal of the positions of the features is within the scope of the present invention.

It is possible to practice the present invention in relation to a regulator for a window assembly having two opposingly movable sliding panes, for example of the type disclosed in U.S. patent application Ser. Nos. 09/126,649 and 09/122,605, the disclosures of which are incorporated herein by reference.

Although depicted in a pickup truck rear window installation, a regulator according to the present invention may also be used in any type of horizontally sliding window assembly, such as for sliding side windows in any type of vehicle.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

The invention claimed is:

1. A sliding window assembly for a vehicle comprising:

a sliding pane movable along a horizontal path of travel between a closed position and an open position;

a horizontal guide rail extending parallel to the path of travel of the sliding pane proximate a lower edge of the pane and having first and second ends;

an elongated carrier plate slidingly movable along the guide rail and having first and second longitudinally spaced attachment portions disposed proximate opposite vertical edge portions of the sliding pane;

first and second pane engagement pairs disposed adjacent respective first and second attachment portions of the carrier plate, each of the pairs comprising a male feature and a mating female feature, one of the male and female features of each pair being secured to the carrier plate proximate a respective attachment portion thereof and the other feature being secured to the sliding pane proximate a respective vertical edge portion thereof, the male and female features of each pair engaged with one another to allow relative movement therebetween along an axis generally perpendicular to the sliding pane to thereby allow movement of the sliding pane relative to the carrier plate along the axis;

at least one flexible, inextensible, drive member attached to the carrier plate; and a drive mechanism operatively connected to the drive member to pull the drive member in a first direction to move the carrier plate toward the first end of the guide rail, and to pull the drive member in an opposite second direction to move the carrier plate toward the second end of the guide rail.

2. The window regulator according to claim 1 wherein the male or female features of the first and a second pane engagement pairs secured to the pane are disposed on a single pane attachment securable to the pane as a unit.

3. The window assembly according to claim 1, wherein first and second ends of the drive member are attached to the carrier plate adjacent respective first and second ends thereof, and an intermediate portion of the drive member engages the drive mechanism.

4. The window assembly according to claim 1 wherein the drive mechanism is disposed remotely from the guide rail and the drive member passes through at least one conduit extending between the guide rail and the drive mechanism.

5. The window assembly according to claim 4 further comprising a stop block attached to the guide rail adjacent the first end thereof to limit sliding movement of the carrier plate toward the first end of the guide rail, an end of the at least one conduit being attached to the stop block to restrain the end of the at least one conduit with respect to the guide rail.

6. The window assembly according to claim 5 wherein a cable guide element is attached to the guide rail adjacent the second end of the guide rail, the first end of the drive member extends from the stop block and is attached to the first end of the carrier plate, and the second end of the drive member extends from the stop block, beyond the carrier plate, passes around the cable guide element and is attached to the second end of the carrier plate.

7. The window assembly according to claim 6 wherein the cable guide element is a pulley.

8. The window assembly according to claim 1 wherein the guide rail comprises a channel enclosing the drive member, and the carrier plate slides along an interior of the channel.

9. The window assembly according to claim 8 wherein the channel has only one lip.

10. The window assembly according to claim 1 wherein the features of the first and a second pane engagement pairs secured to the pane are disposed on a single pane attachment securable to the pane as a unit.

11. The window assembly according to claim 1 wherein the drive member is a cable.

12. The window regulator according to claim 11 wherein the drive mechanism comprises a drive drum engaged with the cable and a reversible electric motor for rotating the drive drum.

13. The window assembly according to claim 1 wherein the first and second ends of the guide rail have respective attachment feet for attachment to surfaces of first and second fixed panes of the window assembly.

* * * * *